US007478960B2

(12) United States Patent
Glover

(10) Patent No.: US 7,478,960 B2
(45) Date of Patent: Jan. 20, 2009

(54) DISPENSING BRUSH

(76) Inventor: J. Scott Glover, 3114 E. Cortez Ct., Irving, TX (US) 75062

( * ) Notice: Subject to any disclaimer, the term of this patent is extended or adjusted under 35 U.S.C. 154(b) by 43 days.

(21) Appl. No.: 10/947,006

(22) Filed: Sep. 21, 2004

(65) Prior Publication Data

US 2005/0111905 A1 May 26, 2005

Related U.S. Application Data

(60) Provisional application No. 60/504,802, filed on Sep. 22, 2003.

(51) Int. Cl.
*A46B 11/02* (2006.01)
*A46B 11/04* (2006.01)

(52) U.S. Cl. ..... 401/188 R; 401/278; 401/279

(58) Field of Classification Search ..... 401/188 R, 401/270, 278, 272, 273, 279, 280, 282; 15/106, 15/110, 114
See application file for complete search history.

(56) References Cited

U.S. PATENT DOCUMENTS

| | | | |
|---|---|---|---|
| 1,049,863 | A | 1/1913 | Happle et al. |
| 1,563,190 | A | 11/1925 | House |
| 1,578,922 | A | 3/1926 | Sargery |
| 1,764,130 | A | 6/1930 | Vardeman |
| 1,860,911 | A | 5/1932 | Trimble |
| 1,908,511 | A | 5/1933 | Dodson |
| 2,000,910 | A | 5/1935 | Appel et al. |
| 2,172,624 | A | 9/1939 | Romani |
| 2,259,928 | A | 10/1941 | Eaton |
| 2,268,928 | A | 1/1942 | Duey |
| 2,308,078 | A | 1/1943 | Hendrickson |
| 2,323,378 | A | 7/1943 | Champion et al. |
| 2,652,949 | A | 9/1953 | Martin |
| 2,774,981 | A | 12/1956 | Bonilla |
| 2,823,401 | A | 2/1958 | O'Higgins |
| 3,118,166 | A | 1/1964 | Bell |
| 3,383,157 | A | 5/1968 | Goldhirsh |
| 3,400,996 | A | 9/1968 | Vandergrift |
| 3,400,999 | A | 9/1968 | Goldstein |
| 3,864,047 | A | 2/1975 | Sherrod |
| 3,910,706 | A | 10/1975 | Dell Bon |
| 3,936,200 | A | 2/1976 | O'Rourke |
| 3,937,235 | A | 2/1976 | Broughton |
| 3,937,582 | A | 2/1976 | Glover et al. |
| 4,068,974 | A | 1/1978 | Meyer et al. |

(Continued)

FOREIGN PATENT DOCUMENTS

| | | | |
|---|---|---|---|
| CA | 2104277 | A | 2/1995 |

(Continued)

*Primary Examiner*—David J. Walczak

(57) ABSTRACT

A dispensing toothbrush includes a toothpaste filled reservoir handle which is attached to a hollow neck which is integral with a hollow brush head. A piston is movable within the reservoir handle for pushing toothpaste toward the hollow neck by way of a suction plunger. A plunger actuating button is connected to the suction plunger which forms first and second chambers in communication with the reservoir handle and the hollow neck. Depressing the plunger button depresses the suction plunger and pushes toothpaste through the hollow neck and a hole in the brush head onto the brush bristles. A vented cover is disposed over the brush head and a floss dispenser is attached to the reservoir handle opposite the end which is attached to the hollow neck.

16 Claims, 7 Drawing Sheets

U.S. PATENT DOCUMENTS

| | | | | |
|---|---|---|---|---|
| 4,088,412 | A | 5/1978 | Del Bon | |
| 4,135,831 | A | 1/1979 | Reitknechi | |
| 4,201,490 | A | 5/1980 | D'Angelo | |
| 4,221,492 | A | 9/1980 | Boscardin et al. | |
| 4,269,207 | A | 5/1981 | Konrad et al. | |
| 4,521,128 | A | 6/1985 | O'Neal | |
| 4,622,984 | A | 11/1986 | Gaebel | |
| 4,685,819 | A | 8/1987 | Endo | |
| 4,692,047 | A | 9/1987 | Endo | |
| 4,695,177 | A | 9/1987 | Kuo | |
| 4,787,765 | A | 11/1988 | Kuo | |
| 4,890,349 | A | 1/1990 | Nitzsche | |
| 5,039,244 | A * | 8/1991 | Cheng | 401/176 |
| 5,062,728 | A | 11/1991 | Kuo | |
| 5,158,383 | A | 10/1992 | Glover et al. | |
| 5,346,324 | A | 9/1994 | Kuo | |
| 5,393,153 | A | 2/1995 | Bouthillier et al. | |
| 5,950,641 | A | 9/1999 | Taveras | |
| 6,039,489 | A | 3/2000 | Harman et al. | |
| 6,179,503 | B1 | 1/2001 | Taghavi-Khanghah | |
| 6,206,600 | B1 | 3/2001 | Rosenberg et al. | |
| 6,390,103 | B1 * | 5/2002 | Manso | 132/309 |
| 6,406,207 | B1 * | 6/2002 | Wiegner et al. | 401/272 |

FOREIGN PATENT DOCUMENTS

| | | |
|---|---|---|
| DE | 2152512 | 4/1972 |
| DE | 3514600 | 8/1986 |
| EP | 123518 | 10/1984 |
| FR | 2 438 443 | 6/1980 |
| FR | 2598300 A1 | 11/1987 |
| FR | 832415 | 9/1998 |
| GB | 2338891 A | 1/2000 |
| IT | 729378 | 12/1966 |
| UA | 267528 | 8/1927 |

* cited by examiner 50
60
58
52
ø24.2
ø23.6
ø5.0
ø6.0
B 50
56
9
58
52
9

66
74
82
ø14.0
ø11.0
60.0°
ø8.0
ø4.0
ø10.0
68

2BTTF2
66
7
66
70
7

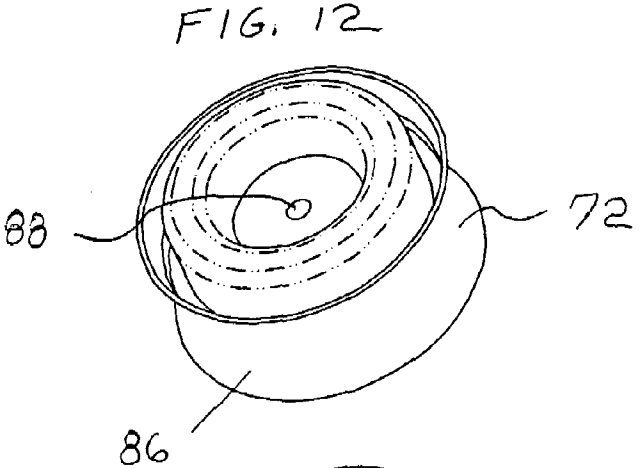
FIG. 12
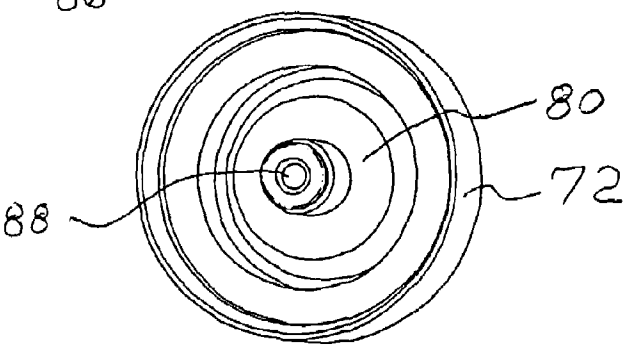
FIG. 13
FIG. 14
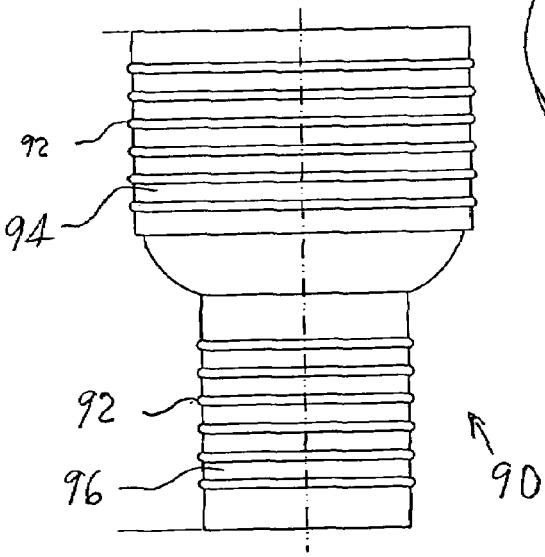
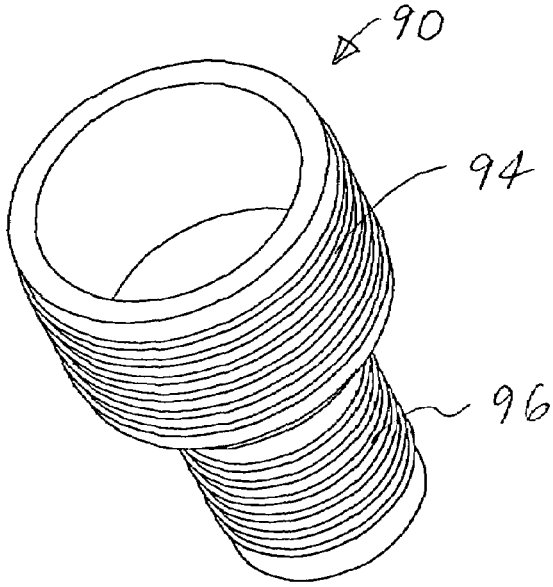
FIG. 15

DISPENSING BRUSH

CROSS-REFERENCE TO RELATED APPLICATIONS

This application is a continuation-in-part of U.S. Provisional Application No. 60/504,802 filed date Sep. 22, 2003.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to brush type cleaning devices, and in one of its aspects to a brush type cleaning device which dispenses a cleaning compound or other flowable material, such as a toothbrush which dispenses toothpaste or gel or other dentifrice and dental floss.

2. Description of Related Art

U.S. Pat. No. 5,158,383 (Glover et al.) shows a paste dispensing brush which includes a stem 12 having a tapered bore therein, and a tapered piston 100 disposed within said tapered bore and "having an outer contour which at least substantially corresponds to the contour of said tapered bore such that said tapered piston will nest in said tapered bore."

U.S. Pat. No. 6,039,489 (Harman et al.) shows a spring which is associated with an entire assembly, occupying the entire width of the cartridge. It also includes a brush aperture blocking member 74, which divides stem bore 18 into a dry portion and a "pumping chamber."

BRIEF SUMMARY OF THE INVENTION

The present invention is a combination brush and dispenser for cleaning compound or other flowable material, such as a toothbrush combined with a toothpaste and floss dispenser so as to provide a complete oral care system that can be carried and used anywhere. This "All-in-One" feature allows for oral care convenience at the home, office, and gym, on the road or while traveling.

The present invention comes complete with a quality soft bristle brush head, 30-60 day usage paste reservoir and 15 yards of dental floss (30-60 day supply) as well the product is designed to use a replacement cartridge. The unit comes with a clear head cover that is side vented for cross action venting to allow the brush to dry faster after use.

The present invention has an upper assembly that includes a clear head cover, brush head/neck, plunger button, suction plunger, spring, feed tube straw, ball check connect, and adapter, which can be threaded or a snap-lock adapter. The lower assembly includes of an o-ring, a clear paste reservoir handle, piston, an optional stainless steel metal cleat, a bottom flip cover, a base cap with a floss spool post and cutter.

The present invention works by installing the lower assembly with the upper assembly. Depressing the plunger button depresses the suction plunger. This creates a suction which draws paste up from the paste reservoir past the ball check connect and into the feed tube straw which allows paste to be deposited onto the base of the bristle brush head. Once the plunger button is released the plunger pushes up the feed tube straw so as to seal off the opening in the bristle brush head from backwash contaminates and prevents the paste from drying up. As paste is removed the piston and metal cleat travel up the paste reservoir handle creating a solid platform for the paste to push against allowing the process described above to be ready for the next use. The floss included in the paste reservoir handle is pulled from the bottom of the base cap and cutter and then easily removed for use. A bottom flip cap protects the floss from outside elements.

The combination of the suction plunger and the feed tube straw provide a positive suction to pull the paste from the paste reservoir handle while pulling up the piston and metal cleat. As well, this design allows the paste reservoir handle to be fully replaceable, by the o-ring air is sealed off at the lower assembly and upper assembly connection.

An alternative embodiment of a toothpaste dispensing toothbrush according to the present invention a floss dispenser which includes a floss assembly and a bottom flip cap. The floss assembly houses a floss spool and a floss cutter. It also includes a brush head and neck. A hollow neck, which allows the feed tube to travel, includes an integrated soft rubber membrane button cover for sealing water or paste leakage. The tear drop designed brush head has an orifice, allowing paste to be extruded into the bristles. The bristle pattern is designed to allow the paste to flow upward to the top of the bristles. Molded in the hollow stem is an end closed point indentation to act as a sealing point for a straight feed tube straw. The connection male sleeve portion of this assembly is designed to permanently connect to the paste reservoir handle or allow for replacement cartridge acceptance. The depth and width of this sleeve provides adequate strength at this at this pressure point. Included in the molding are positioning and locking tabs for ease of assembly to position and seal this connection to the replaceable paste reservoir cartridge handle. A waterproof membrane is molded into the base of the neck and upper assembly to prevent water, bacteria and or paste from leaking into or out of the actuation plunger button area. The membrane material acts to grip the clear head cover in a secured locking position when not in use. The bristles are trimmed to and contoured to naturally cradle the teeth, providing a leading cleaning edge on the front end and a sweeping action on the tail.

The reservoir handle has a slight conical shape allowing the lower piston to travel easily in an upward direction and harder in a downward direction. An integrated conical shaped orifice on fixed positioned platform allows a solid foundation for a suction plunger and a plunger button to push off of.

These and other objects, advantages and features of this invention will be apparent from the following description taken with reference to the accompanying drawing, wherein is shown a preferred embodiment of the invention.

BRIEF DESCRIPTION OF THE SEVERAL VIEWS OF THE DRAWING

FIG. 12 is a top perspective view of a piston of the dispensing toothbrush of FIG. 5;

FIG. 13 is a bottom perspective view of the piston of FIG. 12;

FIG. 14 is an elevational view of a suction plunger of the dispensing toothbrush of FIG. 5;

FIG. 15 is a top perspective view of the suction plunger of FIG. 14;

DETAILED DESCRIPTION OF THE INVENTION

Figure 1:
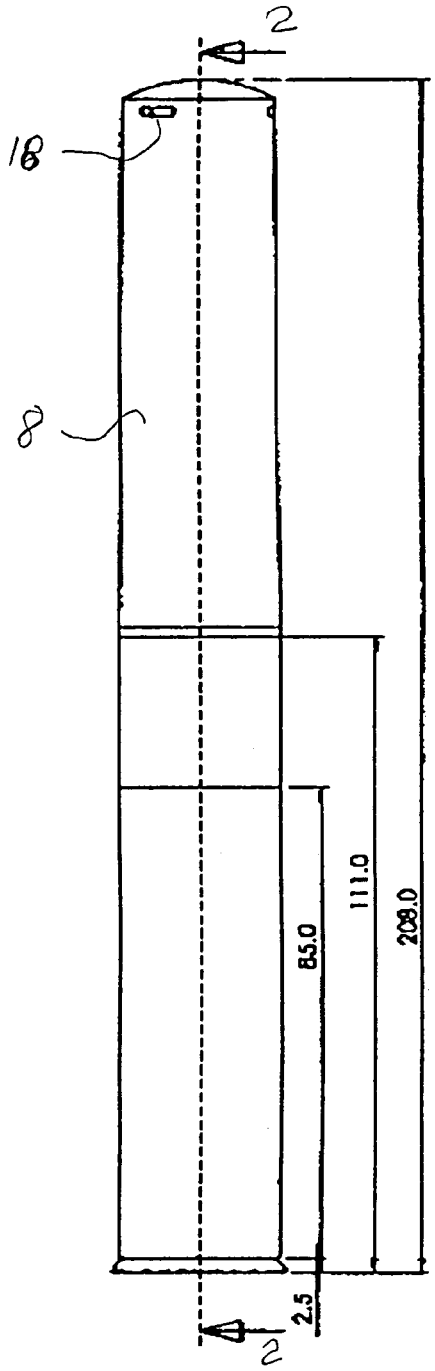
FIG. 1 is a dispensing toothbrush according to the present invention.
Figure 2:
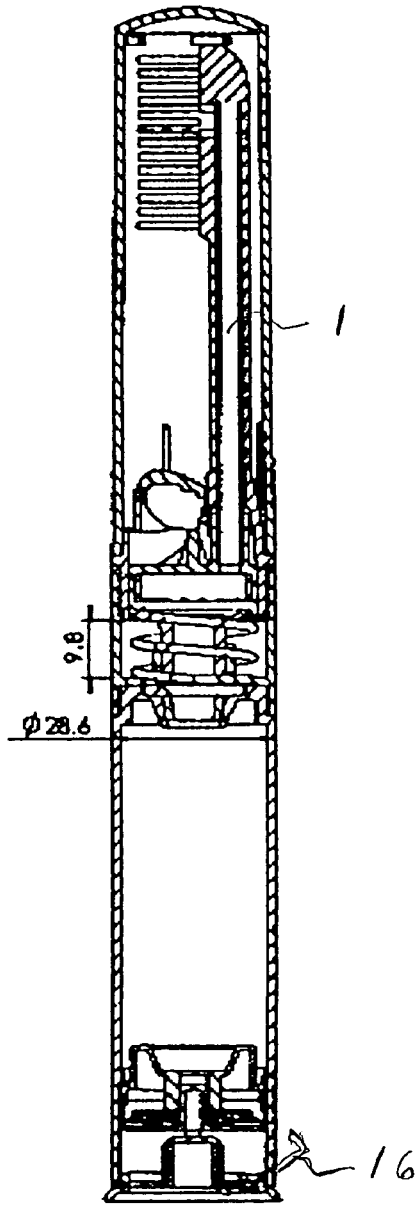
FIG. 2 is a vertical cross-sectional view of the dispensing toothbrush of FIG. 1.
Figure 4:
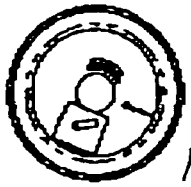
FIG. 4 is a bottom view of a floss cutter of the dispensing toothbrush of FIG. 1.
Figure 3:
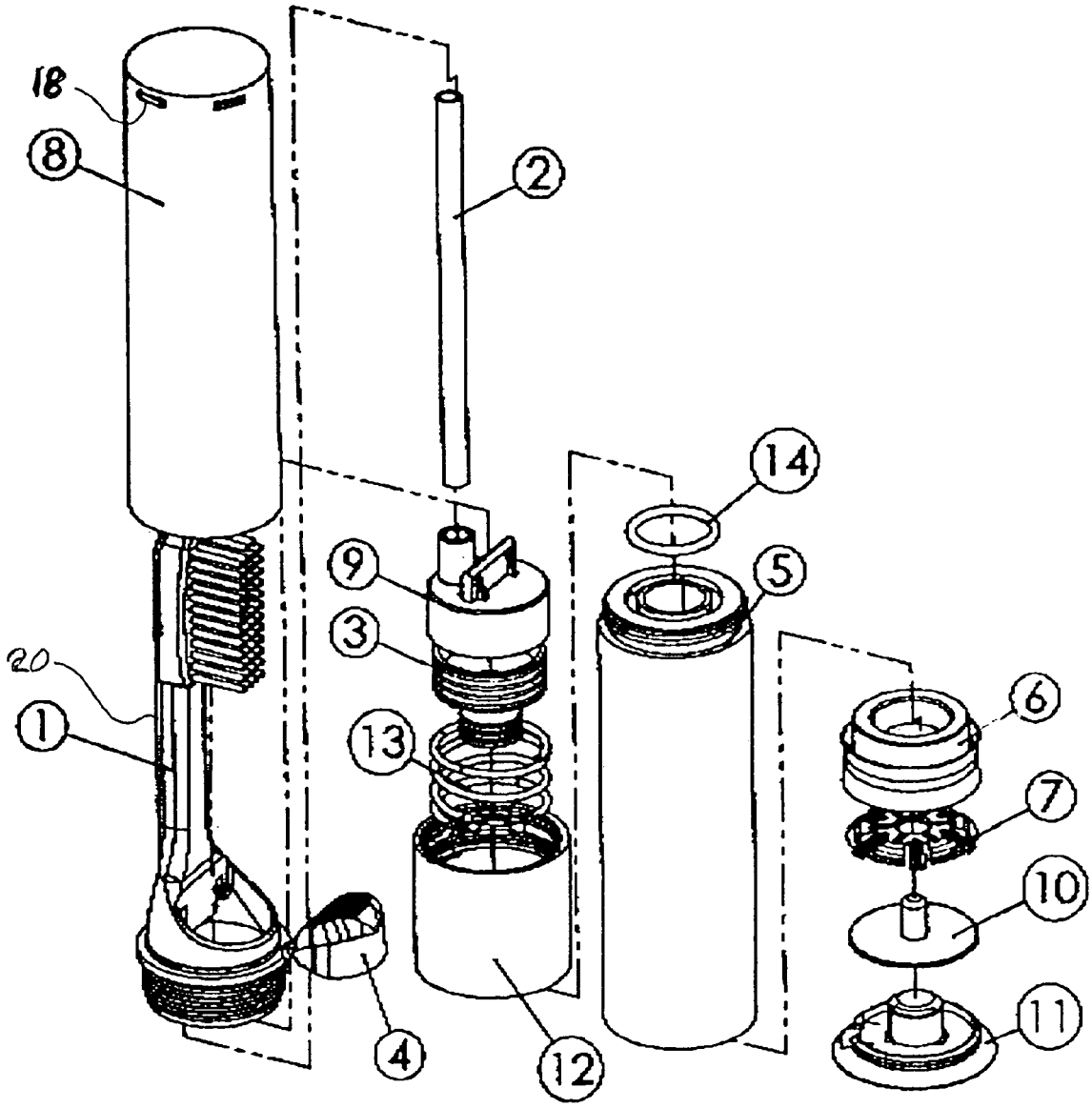
FIG. 3 is an assembly view of the dispensing toothbrush of FIG. 1.
Figure 5:
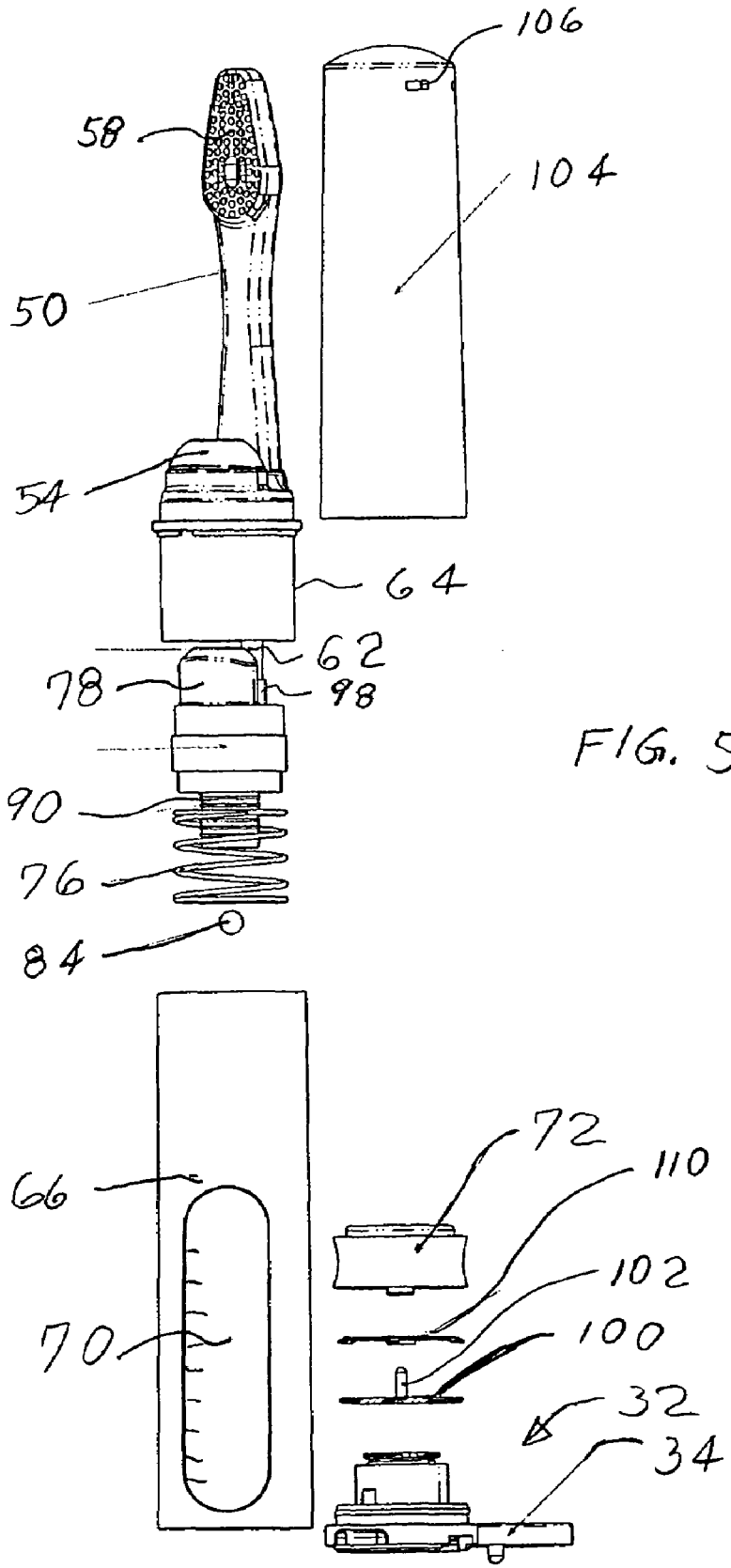
FIG. 5 is an exploded view of an alternative embodiment of a dispensing toothbrush according to the present invention.
Figures 6A, 6B, 7, 8, 9:
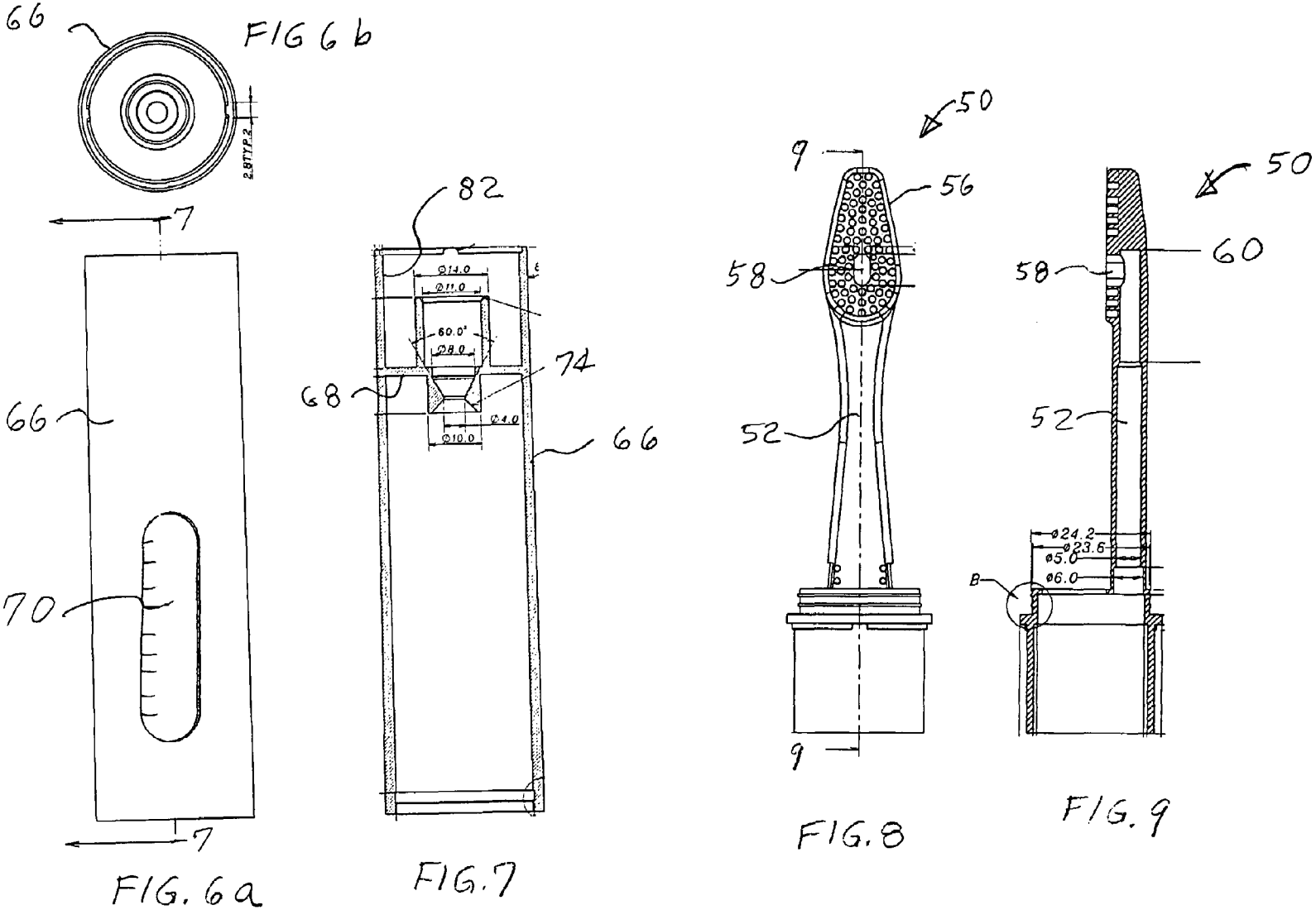
FIG. 6*a* is an elevational view of a reservoir handle of the dispensing toothbrush of FIG. 5.
FIG. 6*b* is a top view of the reservoir handle of FIG. 6*a;*
FIG. 7 is a sectional view of the reservoir handle of FIG. 6*a* taken along the lines 7-7 of FIG. 6*a;*
FIG. 8 is a front elevational view of toothbrush head of the dispensing toothbrush of FIG. 5.
FIG. 9 is a sectional view of the toothbrush head of FIG. 8 taken along the lines 9-9 of FIG. 8.
Figure 11:
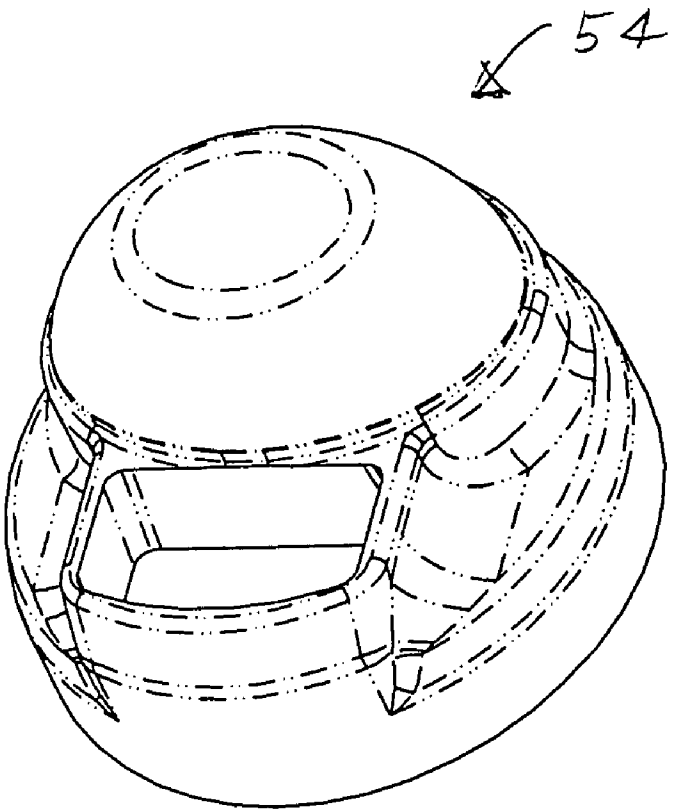
FIG. 11 is a cover for the plunger button of FIG. 10.
Figure 10:
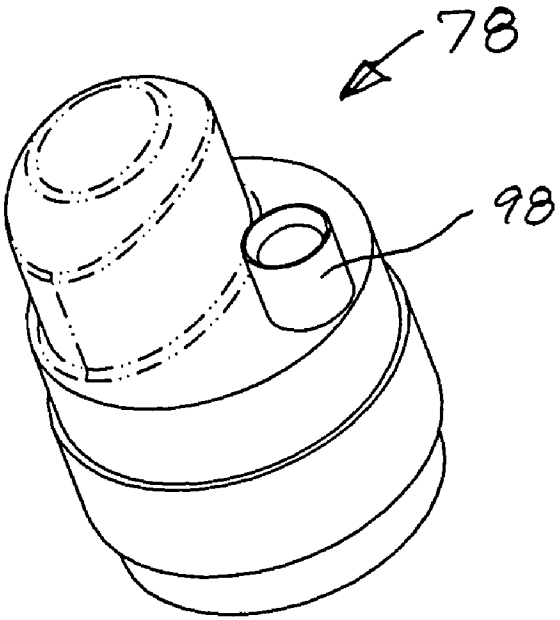
FIG. 10 is a top perspective view of a plunger button of the dispensing toothbrush of FIG. 5.
Figure 16:
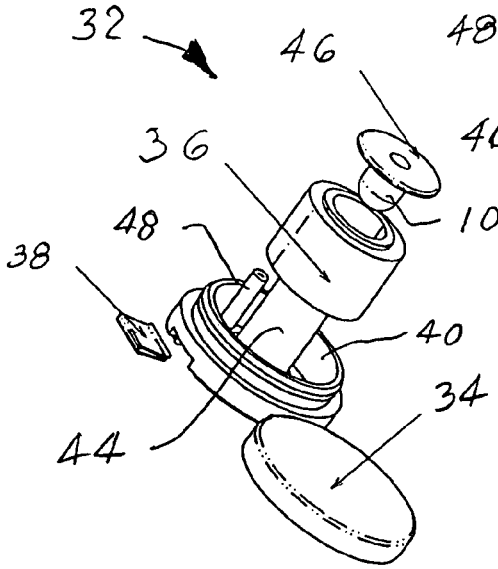
FIG. 16 is a top perspective view of an unassembled floss dispenser of the dispensing toothbrush of FIG. 5.
Figure 17:
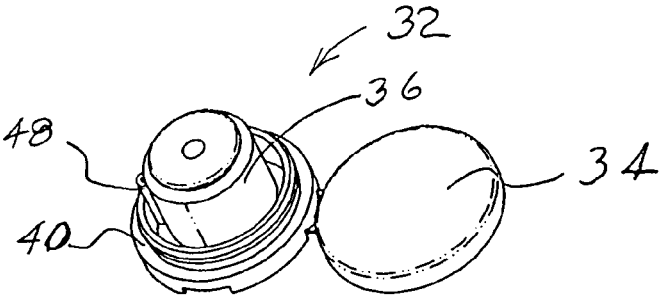
FIG. 17 is a top perspective view of assembled floss dispenser of FIG. 16.
Figure 18:
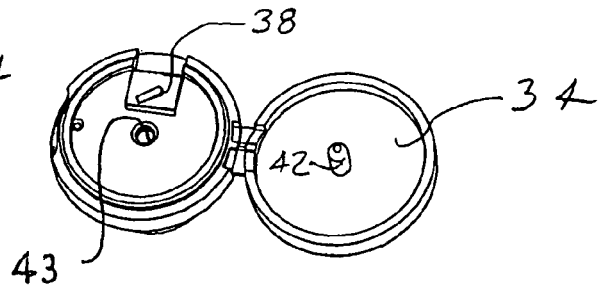
FIG. 18 is a bottom perspective view of the floss dispenser of FIG. 17.

Referring now to the drawing, and in particular to FIGS. 1 through 3, the present invention has an upper assembly that comprises of a clear head cover 8, a brush head/neck 1, plunger button 4, a suction plunger 3, a spring 13, a feed tube straw 2, a ball check connect 9, and an adapter 12, which can be threaded or a snap-lock adapter. The lower assembly comprises of an o-ring 14, a clear paste reservoir handle 5, a piston 6, a stainless steel metal cleat 7, a bottom cover 10, a base cap with floss spool post and a cutter 11.

The present invention works by installing the lower assembly with the upper assembly. By depressing on plunger button 4, which causes a rocking or levering motion, the ball check connect 9 depresses the suction plunger 3 this creates a suction which draws paste up from the paste reservoir 5 past the ball check connect 9 and into the feed tube straw 2 which allows paste to be deposited onto the bristle brush head 1. Once the plunger button 4 is released the spring 13 pushes up the feed tube straw 2 so as to seal off the opening in the bristle brush head 1 from backwash contaminates and prevents the paste from drying up. As paste is removed the piston 6 and metal cleat 7 travel up the paste reservoir handle 5 creating a solid platform for the paste to push against allowing the process described above to be ready for the next use. The floss included in the paste reservoir handle 5 is pulled from the bottom of base cap and cutter 11 then easily removed for use. A bottom flip cap 16 protects the floss from outside elements.

The combination of suction plunger 3 and feed tube straw 2 provide a positive suction to pull the paste from paste reservoir handle 5 while pulling up piston 6 and metal cleat 7. As well, this design allows paste reservoir handle 5 to be fully replaceable, by o-ring 14 air is sealed off at the lower assembly and upper assembly connection.

As can now be seen, in one aspect, the present invention is a combination toothbrush, toothpaste and floss dispenser so as to provide a complete oral care system that can be carried and used anywhere. This "All-in-One" feature allows for oral care convenience at the home, office, and gym, on the road or while traveling. The present invention comes complete with a quality soft bristle brush head, 30-60 usage paste reservoir and 15 yards of dental floss 30-60 day supply and is designed to use a replacement cartridge. The unit comes with a clear head cover 8 that is side vented 18 for cross action venting to allow the brush to dry faster after use.

Another aspect of the invention is a molded ridge 20 along the back of neck 1 which functions as a tongue scraper.

Referring now to FIG. 5 and FIGS. 16-18, an alternative embodiment of a toothpaste dispensing toothbrush according to the present invention is referred to generally by reference numeral 30. Toothbrush 30 includes a floss dispenser 32 which includes a floss assembly and a bottom flip cap 34. The floss assembly houses a floss spool 36 and a floss cutter 38. The floss assembly and bottom flip cap protect the floss from soiling, as well allow the unit to stand upright. The floss assembly includes a molded plastic base 40 with integrated hinged flip lid cover cap 34, which includes a center post locking pin 42 for engaging a hole 43 formed in the base. A fixed molded hollow center post 44 is sized to receive floss spool 36 with a lower shoulder which allows the spool to spin freely when pulling out floss. Inserting a floss spool locking cap 46, which is installed in the hollow end of center post 44 to prevent the floss spool from being removed or falling off while allowing the spool to spin freely upon activation of pulling the floss string. Integrated is a floss guide post 48 for threading the floss through to ensure the floss removes from the spool without tangling. Stainless steel cutter 38 is inserted in the side of the base under the flip lid cover cap for cutting the desired amount of floss. The flatness of the flip lid cover cap allows the base to stand upright. The upper rim of the floss assembly and bottom flip cap is designed to lock into and become permanently part of the handle paste reservoir by snapping in place.

Referring also to FIGS. 8, 9, 10 and 11, a brush head and neck is referred to by reference numeral 50. A hollow neck 52 for feed tube to travel, includes an integrated soft rubber membrane button cover 54 for sealing water or paste leakage. This part comprises an FDA grade molded plastic hollow neck portion which allows a straight straw type feed tube to slide in an open and closed position within. The tear drop designed brush head 56 has an orifice 58 allowing paste to be extruded into the bristles. The bristle pattern is designed to allow the paste to flow upward to the top of the bristles. Molded in the hollow stem is an end closed point indentation 60 to act as a sealing point for a straight feed tube straw 62. The connection male sleeve portion 64 of this assembly is designed to permanently connect to the paste reservoir handle 66 or allow for replacement cartridge acceptance. The depth and width of this sleeve provides adequate strength at this pressure point. Included in the molding are positioning and locking tabs for ease of assembly to position and seal this connection to the replaceable paste reservoir cartridge handle. A waterproof membrane is molded into the base of the neck and upper assembly to prevent water, bacteria and or paste from leaking into or out of the actuation plunger button area. The membrane material acts to grip the clear head cover in a secured locking position when not in use. The bristles are trimmed to and contoured to naturally cradle the teeth, providing a leading cleaning edge on the front end and a sweeping action on the tail.

Referring also to FIGS. 6, 6*a*, 7, 13 and 13, paste reservoir 66 forms a cartridge handle and houses a paste supply. It is easily gripped and held during use. A fixed platform 68 allows paste to transfer from reservoir handle 66 to upper assembly 50. A clear or translucent plastic reservoir handle or a clear plastic viewing window 70 allows for monitoring the current paste level. With a clear or translucent reservoir handle, a viewing window can be created by applying a label to the outside of the reservoir handle, where the label has a cutout for the viewing window or a clear portion for the viewing window. A piston 72 comprises an FDA grade molded plastic. The interior wall of reservoir handle 66 is in a slight conical shape, becoming more narrow from the bottom to fixed position platform 68, allowing lower piston 72 to travel easily in an upward direction and harder in a downward direction since it wedges itself as it goes up. An integrated conical shaped orifice 74 on fixed positioned platform 68 allows a solid foundation for a suction plunger 90 and a plunger button 78 to push off of The bottom of this part has an indented ring 80 to receive the floss assembly and bottom flip cap. The upper female sleeve connection 82 receives the brush neck upper assembly. Each connection sleeve allows for adequate connection surface since this is a critical force pivot point. An area ½ or greater of the cylinder inside dimension is required. The integrated conical orifice 74 provides a cradle for a check ball 84, a sphere made of plastic or other stable material is inserted into the upper end to control open and closed flow of paste.

Lower upward traveling piston 72 travels from suction of paste, thereby providing a platform for the paste to push from, forcing the paste upward towards upper chamber and the discharge aperture. This part travels within the paste reservoir allowing for a constant positive position for the paste to push off of forcing the material forward. Its design allows for clean sweeping fins to travel upward once the paste is extruded out. The paste material clings to the top of the piston creating a suction pulling the piston upward as it is extruded. A V-Shaped outer wall 86 design reduces the friction and drag on the inside wall of the paste reservoir. A hole 88 is formed in the center of the piston, allowing air to exit the paste chamber during assembly after filling chamber. This bleeding of the air out allows the piston to engage with the paste material creating required suction.

Depressing suction plunger 90 causes a pull push suction action, drawing paste from the reservoir handle and pushing it into the upper assembly. Outer ribs 92 prevent leakage between the upper and lower assembly. This key part is designed of a plastic material for stable memory and exacting tolerances. The outer portions in upper chamber 94 and lower chamber 96 are ribbed to allow sealing to the receiving parts. These ribs prevent air and or paste material seepage. The lower chamber has a three prong molded cross piece to push against the check ball sphere in a controlled vertical movement. This part functions in a push pull suction. When depressed the suction plunger ejects the material stored in the upper bowel and when released the lower chamber draws more material in the upper chamber bowl. This drawing and ejecting function provides ease in operation compounding the efforts while insuring reliability of function.

Interior plunger button 78, along with a feed tube post 98, fits over the upper bowl 94 of suction plunger 90 exerting downward pressure activating the suction plunger then returning to the starting position ready for next actuation. Feed tube straw post 98 allows a connection point for feed tube straw 62. This interior plunger button provides primary actuation. By exerting downward pressure the plunger button allows feed tube straw 62 which is connected to open the paste exiting orifice allowing paste to extrude onto the bristles, while simultaneously depressing the suction plunger. This plunger button is inserted into the sealed receiver in the brush head/neck upper assembly.

A lower piston air hole seal 100 fits into air hole 88 located in the middle of the lower piston. The center molded stem 102 fits firmly into the bottom sealing the air bleed hole. This lower piston base piece provides a seal in the air bleed hole used to allow air to exit the paste reservoir handle after filling. By inserting this piston cover air transfer is eliminated between the paste material and lower piston.

Pliable rubber button membrane 54 is molded into the brush head/neck upper assembly. By being pliable this part provides a gripping for the thumb or fore finger for actuation. It also provides a positive grip for the clear vented head cover 104. This sealed part prevents water, bacteria or debris from entering the paste housing. This pliable part is red in color for identification of the actuation plunger button. A sure grip texture provides a non-slip surface for gripping and activation. The pliable rubber allows for movement and compression of the interior plunger button. As well the pliable shoulders grip and lock the head cover in place.

Straight feed tube straw 62 secures to the interior plunger button post 98 locking in place to become one with the interior plunger button. Whereas when the plunger button is activated the feed tube straw travels from a starting position of closed to an open position when depressed and returning to a closed position when released. An extruded hollow stem is cut to length so as to seal off inside the brush head/neck upper assembly when in the closed position. This hollow straight feed tube straw reduces friction on the inner walls of the hollow neck. The inside diameter provides adequate size to allow flow of the paste material. This straw is hollow allowing paste to travel inside and deposited into the orifice located in the bristled brush head.

Clear vented head cover 104 protects bristled brush head 58 when not in use. The upper side vents 106 allow for cross ventilation reducing drying time between uses. The clear head cover allows the actuation plunger button to be seen and provides a seal from debris. Vent holes in the upper portion allows air to travel across the bristles after use while being protected from debris. This cross ventilation speeds the dry time between uses and prevents bacteria from growing in the moistness of the bristles.

Ball check valve 84 acts as a paste flow restrictor and paste reservoir handle shut off during operation. A small plastic sphere is inserted into the paste reservoir handle lower assembly and upper assembly conical connection orifice. During the operation and flow of paste from the lower assembly and upper assembly the ball is pushed downward sealing off the conical orifice, providing restriction of paste flow until the paste is extruded upward. Upon release the ball is drawn upward allowing paste to flow past it filling the lower chamber of the suction plunger to ready for next activation.

Floss spool retaining disk 46 acts to secure the floss spool to the floss assembly. A plastic disk with a locking cone 108 for securing the floss spool to the floss assembly, this solid domed piece is inserted into the hollow stem in the floss assembly and is held in place by friction fitting. The shoulder from the disk prevents the floss from sliding off the hollow stem and allows the floss spool to spin freely when in use.

A lower piston retaining cleat 110, an optional part, is for varying viscosity paste. This cleat provides additional strength for a secure position of the lower piston from downward pressure. This is a stainless steel retaining cleat attached to the bottom of the lower piston prior to the piston cover being installed. This is a light gauge 3 pronged stamped cleat, which provides a secure position for the lower piston once it travels upward. The prongs dig into the interior paste reservoir handle and prevent the lower piston from traveling in reverse thus providing a secure platform for the paste to extrude upward upon activation. Once the paste is ejected upward the prongs release and travel with the piston to its next location ready for use. Three (3) prongs verses four (4) or more additional prongs provide a stable platform and minimizes points of drag from additional prongs. This cleat will be used on thicker viscosity pastes and is not needed with more liquid viscosity pastes or gels.

A return actuation spring 76, preferably a stainless steel spring, is under the interior actuation plunger button and suction plunger. This part helps in returning the plunger button, suction plunger and feed tube straw into the closed position. This conical shaped stainless steel spring is located under the interior plunger button and suction plunger to force all related parts into a closed position. Upon activation the spring is forced to a coiled position providing tension so that when it is released the force created pushes the feed straw tube and interior plunger button into the closed position. This spring provides a constant force closing off the feed tube straw creating a positive lock sealing off from leakage and or seepage preventing cross contamination of bacteria's and or debris into the paste supply. Depending on the thickness of the paste or other cleaning agent, suction plunger 90 can have enough "springiness" to provide the closing force, doing away with the necessity of a spring.

From the foregoing it will be seen that this invention is well adapted to attain all of the ends and objectives hereinabove set forth, together with other advantages which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawings is to be interpreted as illustrative and not in a limiting sense.

The invention claimed is:

1. A toothpaste dispensing toothbrush, comprising in combination:

a hollow brush head forming a hole;

a hollow neck affixed to the hollow brush head and in open communication therewith;

a reservoir handle attached to the hollow neck and in open communication therewith for containing toothpaste to be dispensed through the hollow neck and the hole in the brush head;

a piston movable within the reservoir handle for pushing the toothpaste toward the hollow neck;

a suction plunger connected between and in open communication with the reservoir handle and the hollow neck;

a plunger button, wherein depressing the plunger button depresses the suction plunger and the suction plunger returns to the undepressed state when the plunger button is released, thereby pulling the piston toward the hollow neck and pushing the toothpaste through the neck to the hole in the brush head;

a base forming a hole;

a flip lid cover cap hingedly connected to the base;

a center post locking pin affixed to the flip lid cover cap for engaging the hole formed in the base;

a center post having at least one hollow end and affixed to the base to receive a floss spool; and a floss spool locking cap for inserting into the hollow end of the center post to prevent the floss spool from being removed or falling off while allowing the spool to spin freely upon activation of pulling the floss string.

2. A toothpaste dispensing toothbrush according to claim 1 further comprising a floss guide post for threading the floss through to ensure the floss removes from the spool without tangling.

3. A toothpaste dispensing toothbrush according to claim 2 further comprising a cutter inserted in the side of the base under the flip lid cover cap for cutting the desired amount of floss.

4. A toothpaste dispensing toothbrush according to claim 1 further comprising a cutter inserted in the side of the base under the flip lid cover cap for cutting the desired amount of floss.

5. A toothpaste dispensing brush, comprising in combination:

a hollow brush head forming a hole;

a hollow neck affixed to the brush head and in communication therewith;

a reservoir handle attached at one end thereof to the neck and in communication therewith for containing toothpaste to be dispensed through the neck and the hole in the brush head;

a piston movable within the reservoir handle for pushing toothpaste toward the neck;

a suction plunger connected between and in communication with the reservoir handle and the neck;

a plunger button, wherein depressing the plunger button depresses the suction plunger and the suction plunger returns to the undepressed state when the plunger button is released, which action moves toothpaste from the reservoir handle through the neck to the hole in the brush head; and a floss assembly attached to the reservoir handle at an end of the reservoir handle opposite the one end, said floss assembly including a base supporting a floss spool, a cover hingedly connected to the base, and a floss cutter for cutting a selected amount of floss from the spool.

6. The toothpaste dispensing brush according to claim 5 further comprising a window formed by said reservoir handle between said ends for viewing the quantity of toothpaste disposed in said reservoir handle.

7. The toothpaste dispensing brush according to claim 5 further including a vented cover removably disposed over the brush head.

8. The toothpaste dispensing brush according to claim 5 further including a closable hole in the piston for bleeding air from the reservoir handle which is otherwise trapped between toothpaste in the reservoir handle and the piston.

9. The toothpaste dispensing brush according to claim 5 further including a cleat engaged with the piston and preventing movement of the piston in a direction toward the floss assembly.

10. A toothpaste dispensing toothbrush, comprising in combination:

a hollow brush head forming a hole;

a hollow neck affixed to the brush head and in communication therewith;

a reservoir handle attached to the neck and in communication therewith for containing toothpaste to be dispensed through the neck and the hole in the brush head;

a piston movable within the reservoir handle for pushing toothpaste toward the neck;

a suction plunger connected between and in communication with the reservoir handle and the neck, the suction plunger including an upper bowl forming a first chamber and a lower bowl of smaller diameter than the upper bowl and forming a second chamber in communication with the first chamber; and a plunger button operably connected to the suction plunger for depressing the suction plunger, the suction plunger returning to the undepressed state when the plunger button is released, which action moves toothpaste from the second chamber to the first chamber of the suction plunger.

11. The toothpaste dispensing toothbrush according to claim 10 further comprising a feed tube disposed in the neck and brush head and, in communication with the suction plunger and movable with the plunger button, wherein toothpaste moves through the neck and through the feed tube, and wherein the hollow portion of the brush head extends beyond the hole and the feed tube extends into the portion of the brush head extending beyond the hole and stops the flow of toothpaste through the hole when the plunger button is released.

12. The toothpaste dispensing toothbrush according to claim 10 further comprising a check valve for preventing flow of toothpaste from the neck to the reservoir handle.

13. The toothpaste dispensing toothbrush according to claim 10 further including a return spring disposed between the reservoir handle and the neck, aiding the suction plunger in returning to the undepressed state when the plunger button is released.

14. The toothpaste dispensing toothbrush according to claim 10 further including spaced apart circumferential seal ribs formed on the exterior of the upper bowl and the lower bowl, respectively.

15. A toothpaste dispensing toothbrush, comprising in combination:

a hollow brush head forming a hole;

a neck affixed to the brush head and including a passage formed therein and in communication with the hole, the neck including a base formed as a cylindrical sleeve;

a reservoir handle attached to the neck at the base and containing toothpaste to be dispensed through the neck to the hole in the brush head;

a piston movable within the reservoir handle for pushing toothpaste toward the neck;

a suction plunger connected between and in communication with the reservoir handle and the neck by way of first and second chambers formed in the suction plunger;

a plunger button connected to the suction plunger wherein depressing the plunger button depresses the suction plunger and the suction plunger returns to the undepressed state when the plunger button is released, thereby pulling the piston toward the neck and pushing toothpaste through the neck to the hole in the brush head;

a membrane cover disposed over and in engagement with the plunger button; and a vented cover removably covering the brush head and releasably retained in engagement with the membrane cover.

16. The dispensing toothbrush according to claim 15 including a window formed in the reservoir handle for viewing the quantity of toothpaste therein.

* * * * *